United States Patent [19]

Limousin

[11] Patent Number: 4,538,720

[45] Date of Patent: Sep. 3, 1985

[54] APPARATUS FOR TRANSFERRING ARTICLES BETWEEN CONVEYORS

[75] Inventor: Jean-Louis Limousin, Clearwater, Fla.

[73] Assignee: Pet, Incorporated, St. Louis, Mo.

[21] Appl. No.: 478,899

[22] Filed: Mar. 25, 1983

[51] Int. Cl.[3] ..... B65G 47/02

[52] U.S. Cl. ..... 198/416; 198/427; 198/468.2; 53/499; 53/557

[58] Field of Search ..... 198/427, 436, 486, 416, 198/426, 433, 621, 425, 460; 53/499, 557, 553

[56] References Cited

U.S. PATENT DOCUMENTS

| | | | |
|---|---|---|---|
| 1,451,879 | 4/1923 | Lacke | 198/621 |
| 3,189,160 | 6/1965 | Holland, Jr. | 198/427 |
| 3,529,708 | 9/1970 | Dybala | 198/621 |
| 3,701,410 | 10/1972 | Shields | 198/621 |
| 3,729,084 | 4/1973 | Stuart et al. | 198/426 |
| 3,944,049 | 3/1976 | Graybill | 198/460 |
| 4,104,984 | 8/1978 | Kellermann et al. | 198/427 |
| 4,122,938 | 10/1978 | Walz et al. | 198/416 |
| 4,214,419 | 7/1980 | Allen et al. | 53/553 |
| 4,265,355 | 5/1981 | Davis | 198/427 |
| 4,394,902 | 7/1983 | Mazzoni | 198/436 |

FOREIGN PATENT DOCUMENTS

| | | | |
|---|---|---|---|
| 1256152 | 12/1967 | Fed. Rep. of Germany | 198/427 |
| 718657 | 10/1966 | Italy | 198/437 |
| 36890 | 3/1979 | Japan | 53/557 |

*Primary Examiner*—Joseph E. Valenza
*Assistant Examiner*—Daniel R. Alexander
*Attorney, Agent, or Firm*—Frijouf, Rust & Pyle

[57] ABSTRACT

An apparatus is disclosed for transferring articles between adjacent conveyors. The apparatus includes a first conveyor for conveying articles therealong. A pushing device includes a pair of spaced plates that are disposed in the same plane. The plates move transversely relative to the articles supported by the first conveyor. A pair of gripping arms move to a first position to grasp the laterally pushed articles. The gripping arms together with the grasped articles are moved laterally and away from the direction of movement of the articles along the first conveyor. The gripping arms are moved to a second position in which the articles are released onto a second conveyor disposed adjacent to and laterally relative the first conveyor. The apparatus has particular utility relative to the stabilization of packaged articles during transit through a wrapping and sealing station prior to heat shrinkage.

19 Claims, 12 Drawing Figures

APPARATUS FOR TRANSFERRING ARTICLES BETWEEN CONVEYORS

BACKGROUND OF THE INVENTION

1. Field of the Invention

This invention relates to apparatus for transferring articles between conveyors and more particularly relates to apparatus in which packaged articles are transferred laterally from a first conveyor through a wrapping and sealing station for subsequent heat shrinkage of said wrapped packages. Such wrapping, sealing and heat shrinkage is known in the art as secondary wrapping.

2. Description of the Prior Art

Apparatus for transferring articles or packages from a first conveyor laterally through a wrapping and sealing station are well known in the art. However, in recent years there has been a marked increase in the demand for the wrapping of relatively thin packages and this has posed problems with regard to the stability of such packages during transit between adjacent conveyors.

More particularly, with the advent of small, thin, rectangular packages containing soft drinks or milk or the like, a need has existed for an efficient apparatus for shrink wrapping a unit of three rectangular packages together with a drinking straw.

In the prior art apparatus, units comprising three or more packages have been pushed laterally relative to the direction of movement of the packages on a first conveyor. This lateral pushing of the packages deposits the packages at the first station whereat the packages are encircled by a thin film of heat shrinkable plastics material. The thin film is then sealed to provide a loose tubular wrapping around the unit of packages. A subsequent unit of packages pushed laterally from the first conveyor contacts the previously wrapped unit of packages and urges the same laterally relative to the first conveyor onto a second conveyor for conveying the wrapped packages to a heat shrinking oven which heat shrinks the thin tubular film of plastics material around the unit of packages together with a drinking straw.

Serious problems have existed in the prior art apparatus in that as the wrapped unit of packages is urged onto the second conveyor, there exists a very real possibility that such unit of packages may topple onto the second conveyor rather than remaining in a balanced, upended disposition.

Furthermore, lateral orientation of the individual packages within a wrapped unit can occur, giving rise to an irregularly heat shrunk unit emerging from the heat shrinkage oven.

Additionally, in view of the relatively unstable configuration of the packages to be wrapped and heat sealed, there has been a need in the art for apparatus that would positively support packages during transit through the wrapping and sealing station.

The sequential feeding of individual packages along the first conveyor in order to be pushed laterally through the wrapping and sealing station has also given rise to problems in the prior art apparatus. Such problems arise in the event of one or more packages toppling from an upended position to a prostrate position relative to the first conveyor or during movement of the packages along the conveyor. When a package assumes the prostrate position, the relative positions of adjacent and subsequent packages moving along the first conveyor are altered. If the alteration in respective positions of the packages is not quickly detected, the packages when pushed laterally relative to the first conveyor will be crushed and the operation of the machine will be terminated until the crushed package and contents are removed from the wrapping and sealing station.

Therefore, it is the primary object of this invention to provide an apparatus that overcomes the aforementioned inadequacies of the prior art apparatus and provides an improvement which significantly contributes to the stability of a unit of packages during transfer of the same between adjacent conveyors and for sensing the presence of one or more packages disposed on the first conveyor in a prostrate position.

Another object of the present invention is the provision of gripping arms for positively grasping the unit of packages during transit through a wrapping and sealing station.

Another object of the present invention is the provision of a pair of gripping arms for supportingly engaging a unit of packages during transfer of the packages from a first conveyor to an adjacent second conveyor.

Another object of this invention is the provision of pneumatic means for pivoting a pair of gripping arms from a first position in which the arms grasp a unit of packages to a second position in which the arms release the unit of packages.

Another objective of the invention is the provision of pneumatic means for moving the pair of gripping arms and grasped packages in a direction and at a speed substantially the same as that of the second conveyor.

A further objective of the present invention is the provision of a sensing device disposed adjacent the first conveyor for sensing the relative positions of adjacent packages moving along the first conveyor. The sensing device detects the presence of one or more packages disposed in a prostrate position and controls a gate disposed along the first conveyor to impede the flow of packages therealong.

Another object of the present invention is the provision of a buffer, the buffer being controlled in accordance with the gate to retract and return to an original position to correctly position respective adjacent packages prior to pushing of the packages transversely relative to the first conveyor.

A further object of the present invention is the provision of a bar disposed transversely relative to the second conveyor, the bar toppling the unit of heat shrink-wrapped packages onto a third conveyor which moves substantially parallel to the first conveyor.

The forgoing has outlined some of the more pertinent objects of the present invention. These objects should be construed to be merely illustrative of some of the more pertinent features and applications of the invention. Many other beneficial results can be obtained by applying the disclosed invention in a different manner or modifying the invention within the scope of the disclosure. Particularly with regard to the use of the invention disclosed herein, this should not be construed as limited to apparatus for wrapping and sealing packages with a heat shrinkable plastic film but should include apparatus for transferring any article between adjacent conveyors or the like, particularly in the transfer of articles having a configuration that lacks inherent stability.

SUMMARY OF THE INVENTION

The apparatus of the present invention is defined by the appended claims with a specific embodiment shown in the attached drawings. For the purpose of summarizing the invention, the invention relates to an apparatus for transferring articles between adjacent conveyors, comprising a first conveyor for conveying articles therealong, a pushing means for pushing the articles tranversely relative to the first conveyor, and an article gripping means for grasping the transversely pushed articles. Driven means associated with the gripping means are provided for moving the gripping means together with the grasped articles in a direction transverse relative to the first conveyor onto a second conveyor disposed adjacent and transverse relative to the first conveyor.

In a more specific embodiment of the invention, a plurality of infrared reflective sensing devices are disposed adjacent the first conveyor for sensing the presence of articles passing along the first conveyor. A gate disposed adjacent the first conveyor impedes the flow of articles along the first conveyor in response to control signals received from the sensing devices. A buffer disposed adjacent a second end of the first conveyor retracts in response to control signals from the sensing devices during closure of the gate. The buffer returns to the original position to adjust the relative positions of the articles disposed on the first conveyor prior to the articles being pushed transversely relative to the first conveyor. The pushing means includes a pair of spaced plates disposed in the same plane and moved transversely relative to the first conveyor by a pneumatic ram, the plates being guided by rods slidably engaged within static bearings. The plates move transversely through corresponding openings defined by opposed side walls of the first conveyor to push corresponding units of articles through the openings onto a supporting table disposed adjacent the first conveyor. A gripping means including a pair of gripping arms pivot about axis which are normal to the plane in which the pushing means moves. The gripping arms pivot to a first position in which the unit of articles is supported by the supporting table and gripping arms. Pivoting movement of the gripping arms is accomplished by pneumatically operated cylinder and cooperating piston assemblies. The gripping arms and grasped articles are moved from a first station adjacent the supporting table to a second station disposed above a second conveyor. Movement of the arms is accomplished by pneumatically driven servo mechanisms which move the arms and grasped articles in the same direction and at the same speed as the second conveyor. At the second station, the gripping arms pivot from a first position to a second position in which the articles are released onto the second conveyor.

At the first station, the units of articles are wrapped and sealed with a thin film of plastics material while the units of articles are supported by the gripping arms. At the second station, the wrapped and sealed units are released onto the moving second conveyor which conveys the units through a heat shrinking oven which shrinks the tubular film around the unit of articles. Subsequent to heat shrinkage, the units pass under a bar disposed transversely relative to the second conveyor. The bar topples the units of articles onto a third conveyor which moves in a direction substantially parallel to the first conveyor.

The foregoing has outlined rather broadly the more pertinent and important features of the present invention in order that the detailed description of the invention that follows may be better understood so that the present contribution to the art may be more fully appreciated. Additionally, features of the present invention will be described hereinafter which form the subject of the claims of the invention. It should be appreciated by those skilled in the art that the conception and specific embodiment disclosed may be readily utilized as a basis for modifying or designing other devices for carrying out the same purposes as the present invention. It should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the present invention, reference should be had to the following detailed description taken in connection with the accompanying drawings in which.

Similar reference characters refer to similar parts throughout the several views of the drawings.

DETAILED DESCRIPTION

Figure 1:
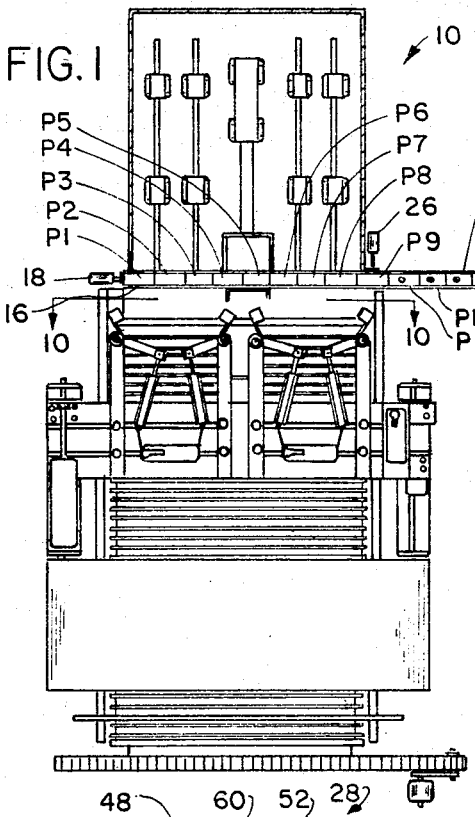
FIG. 1 is a plan view of the apparatus showing two units of articles disposed on the first conveyor prior to being pushed transversely.

FIGS. 1 to 9 are plan views of an apparatus for transferring articles between adjacent conveyors. Each of the FIGS. 1 to 9, respectively, show the progressive operations of the apparatus to transfer the units of articles between an input end of the first conveyor and a third conveyor. More particularly, the apparatus for transferring articles is generally designated 10. Articles or packages to be transferred are designated $p_1$ to $p_{15}$, respectively, in FIG. 1. A first conveyor 12 includes a first end 14 which is an input end for packages $p_1$ to $p_{15}$. The first conveyor 12 also includes a second end 16 disposed adjacent a buffer 18 to be described hereinafter. Conveyor 12 is driven by an electric motor 20 by a suitable drive means and includes opposed sidewalls 22 and 24, respectively. A gate 26 is disposed adjacent sidewall 22. The gate 26 is energized to impede the flow of articles $p_9$ to $p_{15}$ along the first conveyor 12 in response to control signals received from a plurality of infrared reflective sensing devices S1 to S6. The sensing devices S1 to S6 are disposed above the conveyor 12 and between the input end 14 of the conveyor 12 and the gate 26.

Figure 3:
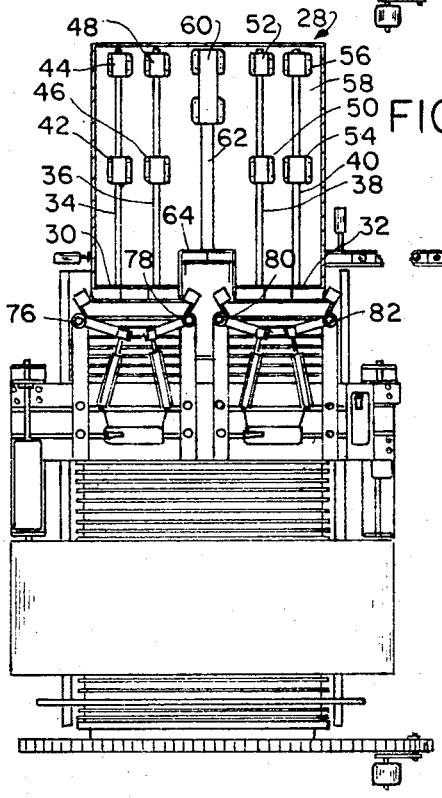
FIG. 3 is a plan view of the apparatus of FIG. 1 showing the units fully pushed transversely and supported on the supporting table.

The pushing means is generally designated 28 and includes a pair of spaced plates 30 and 32, respectively shown best in FIG. 3. The plates 30 and 32 are disposed in the same plane and are rigidly connected to rods 34, 36, and 38, 40. Rods 34 to 40 are slidingly engaged within pairs of static bearings 42 and 44, 46 and 48, 50 and 52, and 54 and 56, respectively. The static bearings 42, 44, 46, 68, 50 52, 54 and 56 are each rigidly secured to a base frame 58 of the apparatus. Transverse movement of the pushing means 28 is controlled by a pneumatic ram 60, rigidly secured to the base frame 58. Ram 60 includes a piston rod 62 rigidly connected to a saddle-shaped member 64 disposed between and rigidly connected to plates 30 and 32.

Figure 4:
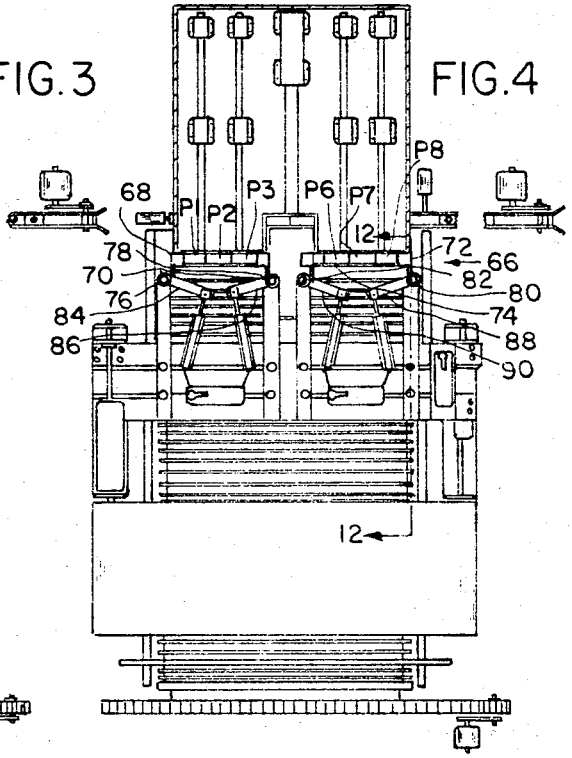
FIG. 4 is a plan view of the apparatus of FIG. 1 showing the gripping arms grasping the units while supported on the supporting table.

The gripping means shown best in FIG. 4 is generally designated 66 and includes gripping arms 68 and 70, 72 and 74. Gripping arms 68 and 70 cooperate to grasp a unit of packages, $p_1$ to $p_3$, pushed transversely by plate 30 while gripping arms 72 and 74 cooperate to grasp a unit of packages, $p_6$ to $p_8$, pushed transversely by plate 32. The gripping arms 68, 70, 72 and 74 pivot about axes 76, 78, 80 and 82, respectively, each of which is normal to the plane in which the pushing means 28 moves as shown in FIG. 10.

Figure 5:
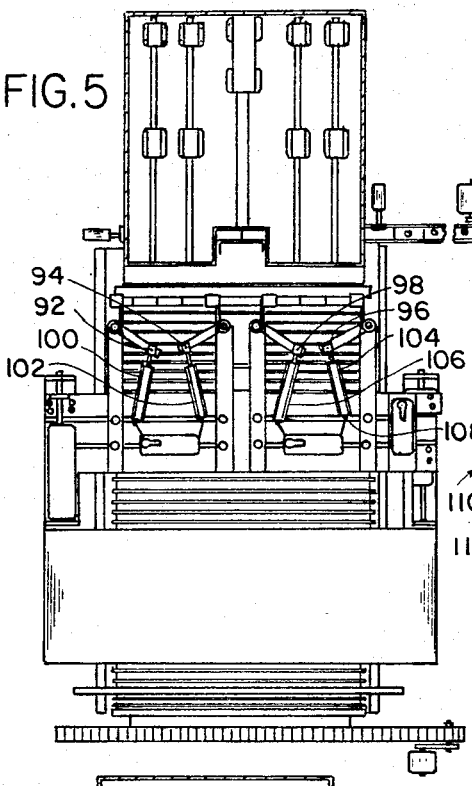
FIG. 5 is a plan view of the apparatus of FIG. 1 showing the gripping arms and grasped units being moved transversely relative to and away from the first conveyor.

The pivoting gripping arms 68, 70, 72 and 74 include linkages 84, 86, 88 and 90, respectively, which connect the respective gripping arm 68, 70, 72 and 74 to clevises 92, 94, 96 and 98, respectively, of pneumatic cylinder and cooperating piston assemblies 100, 102, 104 and 106, respectively, shown in FIG. 5. Each of the cylinder and piston assemblies 100, 102, 104 and 106, is pivotally connected at the end remote from the clevises 92, 94, 96 and 98 to the framework 108 of the gripping means 66 as best shown in FIG. 5.

Figure 10:
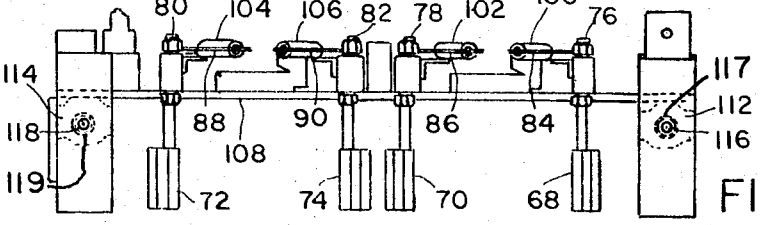
FIG. 10 is a sectional view of the apparatus taken on the line 10—10 of FIG. 1.

The means for moving the gripping means together with the grasped unit of packages is generally designated 110 and includes a servo mechanism which includes a pair of cylinders 112 and 114, respectively shown in FIG. 10. The cylinders 112 and 114 are rigidly secured to the base frame 58 of the apparatus and include movable connecting rods 116 and 118 respectively which are connected to the framework 108 of the gripping means 66. The frame work 108 is slidably mounted on bearings 117 and 119 shown in FIGS. 10, 11 and 12 relative to base frame 58. Movement of the connecting rods 116 and 118 results in a movement of the framework 108 and the associated gripping arms 68, 70, 72 and 74, linkages 84, 86, 88 and 90 and cylinder and piston assemblies 100, 102, 104 and 106 on bearings 117 and 119. Actuation of the cylinders 112 and 114 thereby results in the movement of the gripping arms 68, 70, 72 and 74 and grasped units of packages $p_1$ to $p_3$ and $p_6$ to $p_8$, respectively, from a first station in which the units of packages $p_1$ to $p_3$ and $p_6$ to $p_8$ are disposed transversely adjacent the first conveyor 12 as shown in FIG. 4 to a second station in which the grasped units are disposed above the second conveyor as shown in FIG. 5.

Figure 7:
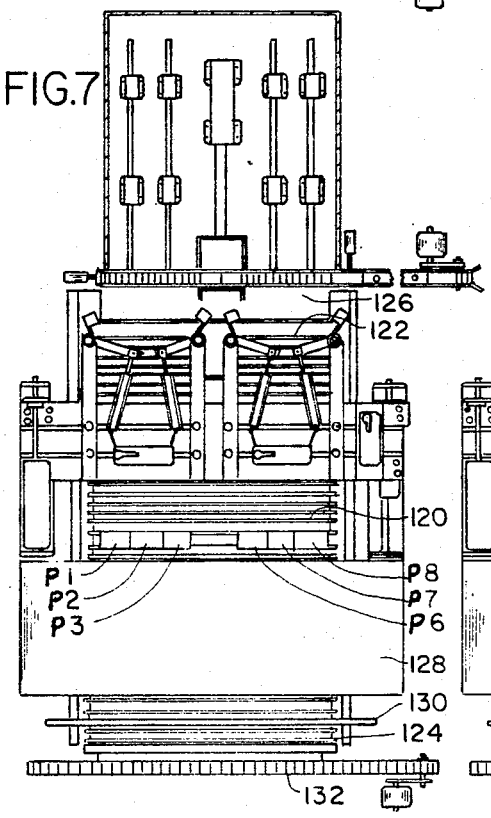
FIG. 7 is a plan view of the apparatus of FIG. 1 showing the gripping arms having returned to the first station and the pushing means restored to push subsequent units of articles.

The second conveyor 120, shown best in FIG. 7, is disposed adjacent the first conveyor 12 but transversely relative thereto. The second conveyor 120 includes an input end 122 and an output end 124. The input end 122 is disposed adjacent the sidewall 24 of the first conveyor 12. A supporting table 126 bridges the gap between the conveyor 12 and the input end 122 of the second conveyor 120. A wrapping and sealing mechanism is disposed adjacent the supporting table 126 but is not shown in the accompanying drawings as the mechanism is well known to those skilled in the art. The mechanism may include various driving rollers for advancing a thin film of plastics material from a supply roll disposed below the conveyor 120 to a mechanism for encircling a unit of packages with a film of wrapping material. The wrapping material is sealed to provide a tubular wrapping for the unit of packages. The wrapping and sealing operation which does not form part of the present invention, is performed at the first station while the unit of packages is supported by the supporting table 126 and the gripping arms. The second conveyor 120 conveys units of packages $p_1$ to $p_3$ and $p_6$ to $p_8$ when the packages are released from gripping arms 68, 70, 72 and 74 disposed in the second position thereof at the second station of the moving means 110. The units of packages together with tubular sealed wrapping are moved by the second conveyor 120 through a heat shrinking oven 128 which heat shrinks the wrapping film around the units of packages and associated drinking straws. The heat shrunk wrapped units emerge from the oven 128 and pass under a bar 130 which is disposed transversely to the direction of movement of the second conveyor 120. Bar 130 strikes the top of the units of packages $p_1$ to $p_3$ and $p_6$ to $p_8$ and topples the same onto a third conveyor 132 disposed substantially parallel to the first conveyor 12. Optional guide bars 133 having guide surfaces 133A, 133B, 133C and 133D insure that the packages L1, L2 and L3 and L6, L7 and L8 are in intimate contact with each other respectively, prior to the heat shrinking operation.

Figure 11:
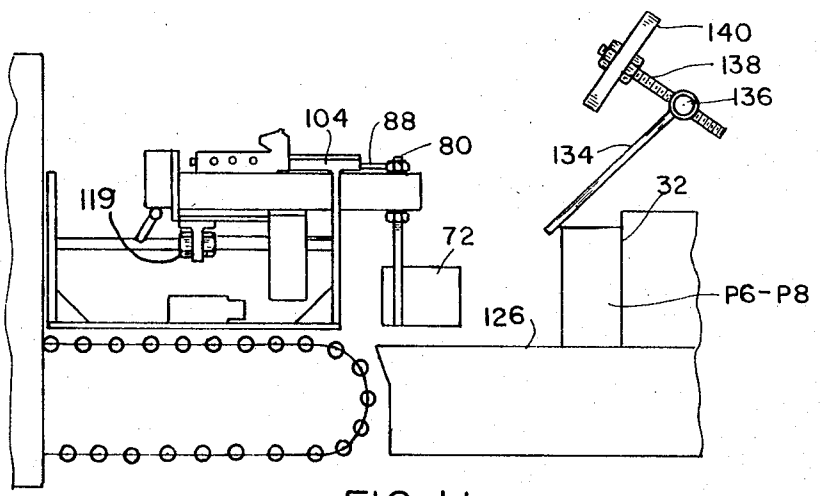
FIG. 11 is an enlarged fragmentary cross sectional view of the apparatus taken on the line 11—11 of FIG. 2.

As shown more particularly in FIG. 11, a unit of packages $p_6$ to $p_8$ is pushed transversely relative to the first conveyor 12 by plate 32. During transverse pushing of the units $p_6$ to $p_8$ across the supporting table 126, the tops of the packages $p_6$ to $p_8$ are stabilized by a pivotably supported flap plate 134 which pivots about a supporting axle 136 extending across the width of the supporting table 126. A threaded extension 138 extends from the flap plate 134 and includes a weight 140 which can be adjustably moved along the length of the extension 138. By adjusting the position of the weight 140 relative to the extension 138, the optimum stabilizing force can be obtained between the flap plate 134 and the top of the units $p_1$ to $p_3$ and $p_6$ to $p_8$ as the packages are transferred from the first conveyor 12 onto the supporting table 126.

Figure 12:
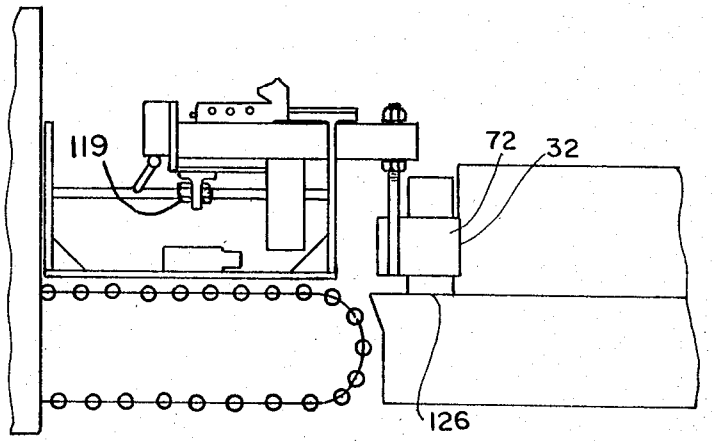
FIG. 12 is an enlarged fragmentary cross sectional view of the apparatus taken on the line 12—12 of FIG. 4.

FIG. 12 shows the unit of packages $p_6$ to $p_8$ disposed at the first station in which the gripping arms 72 and 74 are grasping the sides of the unit while the supporting table 126 is supporting the same.

Figure 9:
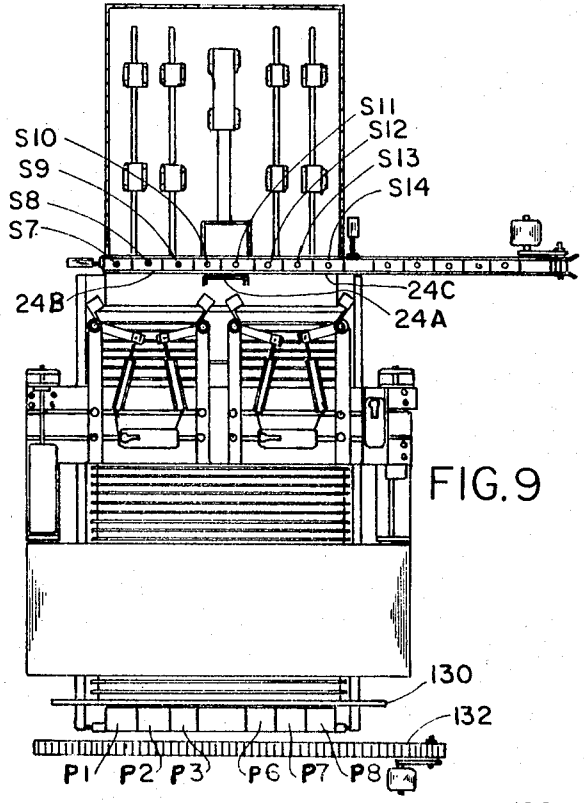
FIG. 9 is a plan view of the apparatus of FIG. 1 showing the buffer restored to its original position and wrapped and heat shrunk units being toppled onto the third conveyor.

In addition to the infrared reflective sensing devices S1 to S6 disposed between the gate 26 and the input end 14 of the first conveyor, additional sensing devices S7 to S14 may be provided as shown in FIG. 9. The infrared reflective sensing devices S7 to S14 detect the presence of one or more packages that have toppled over from the upended to the prostrated disposition. When such irregular disposition of packages is detected relative to packages disposed on conveyor 12 between gate 26 and buffer 18, a visual indication of this condition is emitted and the various operations of the apparatus are shut down until the irregularity has been rectified.

Referring more particularly to the operation of the apparatus for transferring articles, the sequence of operations is shown progressively with reference to FIGS. 1 to 9.

Figure 2:
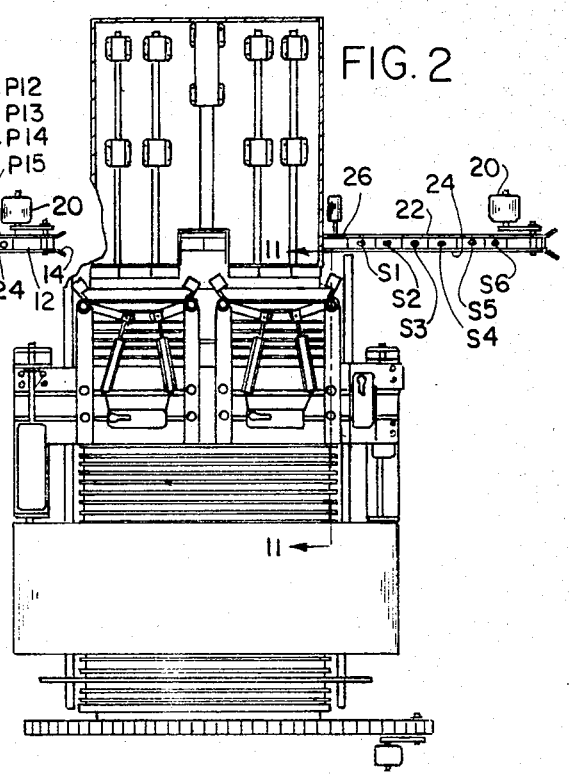
FIG. 2 is a plan view of the apparatus of FIG. 1 showing the units partially pushed transversely relative to the first conveyor.

FIG. 1 shows a plurality of packages $p_1$ to $p_{15}$ moving along the first conveyor 12. The buffer 18 is positioned in an extended position to adjust the relative position of adjacent packages $p_1$ to $p_8$ and aligns the packages in preparation for the transverse pushing operation. When the sensing devices S7 to S14 sense the presence of packages $p_1$ to $p_8$, a signal is sent to close the gate 26. Assuming that no signal is generated by the sensing devices S7 to S14 indicating an irregularity in the disposition of the packages $p_1$ to $p_8$, a signal is sent to retract buffer 18 and to activate the pneumatic ram 60. The ram via piston rod 62 and saddle member 64 urges the plates 30 and 32 transversely relative to the conveyor 12. The plate 30 pushes the packages $p_1$ to $p_3$ and the plate 32 pushes the packages $p_6$ to $p_8$ transversely relative to the conveyor 12 as shown in FIG. 2. With reference to FIG. 2, the gate 26 remains activated during the pushing operation in order to impede the flow of packages $p_9$ to $p_{15}$ along the conveyor 12. Two of the packages $p_4$ and $p_5$ are disposed within the saddle-shaped member 64 during the pushing operation and are located on the conveyor 12 by the saddle member 64 and a portion 24*a* of the sidewall 24 of the first conveyor. The plates 30 and 32 push the packages $p_1$ to $p_3$ and $p_6$ to $p_8$ transversely through openings 24*b* and 24*c*, respectively, of the sidewall 24. The openings 24*b* and 24*c*, respectively, correspond in width with the plates 30 and 32 as shown in FIG. 9.

With reference to the operation of the apparatus as shown in FIG. 3, the spaced plates 30 and 32 push the units of packages $p_1$ to $p_3$ and $p_6$ to $p_8$ onto the supporting table 126. The gripping arms 68, 70, 72 and 74 are disposed in the second position ready to receive the advancing units.

FIG. 4 shows the gripping arms 68, 70, 72 and 74 pivoted to the first position to grasp the sides of the respective units of packages $p_1$ to $p_3$ and $p_6$ to $p_8$. Pivoting of the gripping arms is accomplished by actuation of the respective pneumatic cylinder and cooperating piston assemblies 100, 102, 104 and 106, respectively, which transmit the pivoting force via the clevises 92, 94, 96 and 98 and linkages 84, 86, 88 and 90, respectively. When the units of packages are both supported on the supporting table 126 and by the gripping arms 68, 70, 72 and 74, the wrapping and sealing operation begins. The individual packages $p_1$ to $p_3$ and $p_6$ to $p_8$, being relatively thin and consequently unstable in configuration, could easily be toppled by the wrapping and sealing operation were it not for the positive support afforded by the respective gripping arms.

When the wrapping and sealing of the units of packages $p_1$ to $p_3$ and $p_6$ to $p_8$ has been completed, the cylinder 112 is activated which controls the connecting rod 116 to move the gripping means from the first station as shown in FIG. 4 to the second station shown in FIG. 5. During movement from the first to the second station, the gripping arms remain in the first position to grasp the ends of the respective units of packages as shown in FIG. 5.

Figure 6:
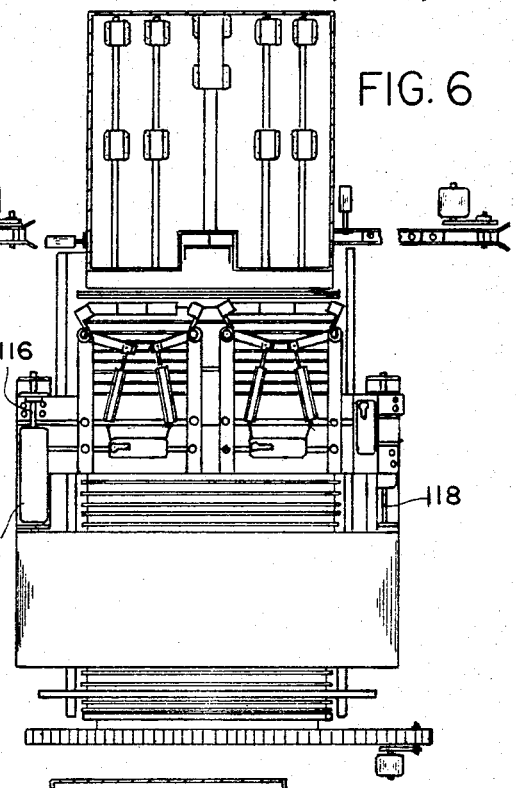
FIG. 6 is a plan view of the apparatus of FIG. 1 showing the gripping arms at the second station, the gripping arms being pivoted to the second position to release the units onto the second conveyor.

As shown in FIG. 6, cylinder 112 and cooperating pistons 100, 102, 104 and 106 are actuated to pivot the gripping arms 68, 70, 72 and 74 to the second position to release the units of packages $p_1$ to $p_3$ and $p_6$ to $p_8$ onto the moving second conveyor 120. Movement of the connecting rod 116 by the cylinder 112 is controlled to approximate the speed of the second conveyor 120 such that when the units of packages are released above the conveyor 120, the wrapped and sealed units are traveling at approximately the same speed as the second conveyor 120. In this manner, toppling of the units upon transfer to the second conveyor 120 is avoided.

The units of packages $p_1$ to $p_3$ and $p_6$ to $p_8$ as shown in FIG. 7, move along the second conveyor 120 and are further adjusted by guide surfaces 133A–133D to enter the heat shrinkage oven 128. At the same time the servo mechanism actuates the cylinder 112 and cooperating connecting rod 116 to return the gripping arms to the first station with the gripping arms still in the second position ready to receive the next pair of units of packages.

Figure 8:
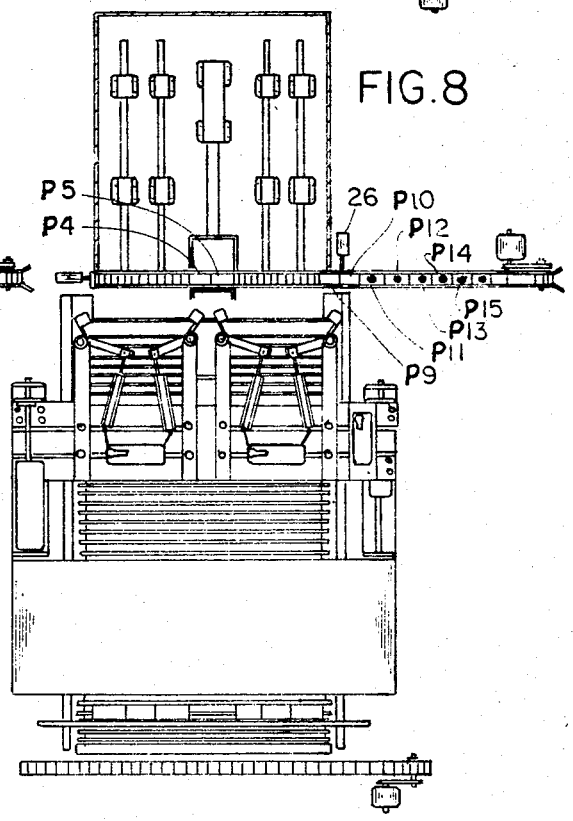
FIG. 8 is a plan view of the apparatus of FIG. 1 showing two articles disposed on the first conveyor moving towards the buffer which is in the retracted position and the gate being opened to permit subsequent articles to proceed to the first conveyor.

FIG. 8 shows units of packages $p_1$ to $p_3$ and $p_6$ to $p_8$ emerging from the heat shrinking oven 128 with a tubular film of plastics material tightly shrunk over the respective packages and drinking straws. The gate 26 is deactivated to permit packages $p_9$ to $p_{15}$ to flow along the first conveyor 12. At the same time, packages $p_4$ and $p_5$ move along the conveyor until the movement is arrested by the buffer 18. The packages $p_4$ and $p_5$ and packages $p_9$ to $p_{14}$ are sensed by sensing devices S7 to S14 which send a signal to the gate 26 which is activated to impede the flow of package $p_{15}$ along the conveyor 12.

As shown in FIG. 9, the buffer 18 is again retracted and the bar 130 topples the units of packages $p_1$ to $p_3$ and $p_6$ to $p_8$ onto the third conveyor 132. In the alternative, variuous other discharge devices may be utilized to receive the packages emanating from the second conveyor.

Although the preferred embodiment has been described employing pneumatically operated driving means, it will be appreciated by those skilled in the art that mechanical, hydraulic or electromagnetic means or the like may be employed in the alternative. Furthermore, as an alternative to the infrared sensing devices, any suitable type of sensing device could be used including mechanical sensing means or microswitch devices. It will be appreciated by those skilled in the art that whereas the preferred embodiment is designed to handle two units of packages per batch, any other number of units per batch could be allowed. Furthermore, whereas a separate pneumatic cylinder and cooperating piston is connected to each individual gripping arm by a suitable linkage mechanism, it would be possible to actuate two or more gripping arms from a single pneumatic cylinder and piston assembly.

Having described the preferred embodiment of the present invention and the operation thereof, it will be apparent to those skilled in the art that the apparatus described hereinbefore overcomes the serious problems associated with the inherent instability of packages as they are transferred between adjacent conveyors. More particularly, the present invention provides an apparatus that not only tightly grips the units of packages during the wrapping and sealing of the same, but also firmly grips the same during transfer of the units onto the adjacent conveyor.

The present invention also provides an apparatus that automatically shuts down in the event of a package on the first conveyor being incorrectly oriented and gives a visual indication to the operator of the apparatus of the irregularity so that such malfunction can be readily remedied.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An apparatus for transferring articles between conveyors, comprising in combination:

a first conveyor;

pushing means for simultaneously pushing a plurality of the articles transversely relative to said first conveyor;

gripping means pivotally mounted adjacent to said first conveyor, said gripping means pivoting from a first position for simultaneously grasping a plurality of the articles as the articles are pushed transversely by said pushing means such that toppling of the articles is inhibited during the change of direction of the articles when pushed transversely, said gripping means pivoting to a second position for simultaneously releasing the articles; and driving means drivingly connected to said gripping means for driving said gripping means together with said grasped articles in a direction transverse relative to said first conveyor, said driving means driving said gripping means between a first station adjacent to said first conveyor and a second station adjacent to a second conveyor disposed transversely relative to said first conveyor, said driving means driving said gripping means at substantially the same speed as the speed of said second conveyor such that toppling of the articles is inhibited when the articles are released from said gripping means at said second station.

2. An apparatus for transferring articles as set forth in claim 1 wherein said first conveyor conveys said articles therealong past a plurality of article sensing devices.

3. An apparatus for transferring articles as set forth in claim 2 wherein said article sensing devices are infrared reflective sensing devices.

4. An apparatus for transferring articles as set forth in claim 3 wherein a gate is disposed adjacent said first conveyor, said gate being controlled in response to signals received from said sensing devices.

5. An apparatus for transferring articles as set forth in claim 4 wherein said first conveyor includes a first and a second end, said first end being an input end for receiving said articles and a buffer disposed adjacent said second end, said buffer being controlled by signals received from said sensing devices, said buffer retracting after closure of said gate.

6. An apparatus for transferring articles as set forth in claim 5 wherein said buffer is disposed in an extended position to adjust the relative positions of said articles on said first conveyor and is moved to a retracted position to enable transverse pushing to said second conveyor.

7. An apparatus for transferring articles as set forth in claim 1 wherein said pushing means and said grasped articles move in substantially the same plane.

8. An apparatus for transferring articles as set forth in claim 7 wherein said pushing means includes a pair of spaced plates disposed in the same plane, said plates cooperating with corresponding openings defined by opposed sidewalls of said first conveyor.

9. An apparatus for transferring articles as set forth in claim 8 wherein said pushing means includes a ram for moving said spaced plates and said articles transversely from said first conveyor through said openings, said spaced plates being guided by rods slidingly engaged within static bearings.

10. An apparatus for transferring articles as set forth in claim 1 wherein said gripping means includes a pair of opposed article grasping arms, said arms being pivotally supported about respective axes, said axes being normal to the plane in which said pushing means moves.

11. An apparatus for transferring articles as set forth in claim 10, wherein said grasping arms move from a first position in which said arms grasp said articles to a second position in which said arms release said articles.

12. An apparatus for transferring articles as set forth in claim 11 wherein each of said grasping arms is moved from a first to a second position by a cylinder and cooperating piston.

13. An apparatus for transferring articles as set forth in claim 1 wherein said driving means for moving said gripping means moves in a plane substantially parallel to the plane in which said pushing means moves.

14. An apparatus for transferring articles between conveyors, comprising in combination;

a first conveyor;

pushing means for pushing articles transversely relative to said first conveyor;

gripping means for grasping said transversely pushed articles, said gripping means being pivotably mounted enabling said gripping means to pivot from a first position in which said gripping means grip said transversely pushed articles to a second position in which said gripping means release said transversely pushed articles;

driving means for driving said gripping means together with said grasped articles in a direction transverse relative to said first conveyor onto a second conveyor disposed adjacent and transverse relative to said first conveyor, said second conveyor conveying wrapped and sealed articles from said gripping means when said gripping means is disposed adjacent a second station whereat said articles are released from said gripping means, said second conveyor conveying said articles through a heat shrinking oven which shrink wraps said articles, said second conveyor conveying said shrink wrapped articles under a bar disposed transversely relative to said second conveyor, said bar toppling said shrink wrapped articles onto a third conveyor which moves in a direction substantially parallel to said first conveyor.

15. An apparatus for transferring articles as set forth in claim 12 wherein said gripping means for releasing said grasped articles includes a pneumatically operated cylinder and cooperating piston, said cylinder and cooperating piston being pneumatically controlled in response to the relative positions of articles moving along said first conveyor as sensed by sensing devices disposed adjacent said first conveyor.

16. An apparatus for transferring articles as set forth in claim 1 wherein said pushing means, said gripping means, and said driving means for moving said gripping means are pneumatically controlled in accordance with a time sequence which is triggered by the relative positions of adjacent articles disposed along said first conveyor.

17. An apparatus for transferring articles as set forth in claim 16 wherein a visual warning device is activated in the event of one or more articles being disposed along said first conveyor in an incorrectly oriented position, said visual warning device additionally deactivating said apparatus.

18. A machine for moving packages between adjacent conveyors comprising in combination;

a first conveyor for conveying said packages therealong; transferring means for transferring said packages laterally relative to said packages moving along said first conveyor;

a package supporting table disposed adjacent said first conveyor for receivably supporting said laterally transferred packages;

package supporting arms for supportingly engaging said packages;

means for moving said arms from a first position in which said arms supportingly engage said packages to a second position in which said arms release said packages;

a second conveyor disposed adjacent said first conveyor for conveying said packages in a direction laterally to and away from said first conveyor; and driving means for driving said arms parallel to said direction of movement of said second conveyor, said driving means driving said arms at substantially the same speed as the speed of said second conveyor such that toppling of the packages is inhibited when the packages are released from said arms onto said second conveyor.

19. An apparatus for transferring packages between adjacent conveyors comprising in combination:

a first conveyor for conveying said packages along said first conveyor;

sensing means disposed adjacent said first conveyor for sensing the presence of packages moving along said first conveyor;

a gate disposed adjacent said first conveyor for impeding the flow of said packages therealong, said gate being controlled by said sensing means;

a pushing means for pushing a plurality of said packages laterally relative to said packages moving along said first conveyor;

a plate hingedly secured above said laterally moved packages, said plate rotating about an axis parallel to said packages moving along said first conveyor, said plate stabilizing said plurality of packages during lateral movement of said packages relative to said first conveyor;

a package supporting table disposed adjacent said first conveyor for receivably supporting said laterally pushed packages;

package supporting arms for supportingly engaging said packages;

means for moving said arms from a first position in which said arms supportingly engage said plurality of packages to a second position in which said arms release said packages;

a second conveyor disposed adjacent said first conveyor for conveying said packages in a direction laterally and away from said first conveyor; and driving means for driving said arms parallel to said direction of movement of said second conveyor, said driving means enabling said plurality of packages to be moved from a wrapping and sealing station in which said plurality of packages are supported by said table and said arms disposed in said first position to a second station in which said plurality of packages are released by said arms disposed in said second position and driven at substantially the same speed as said second conveyor to transfer said plurality of packages onto said second conveyor.

* * * * *